US005560405A

United States Patent [19]

Harris et al.

[11] Patent Number: 5,560,405

[45] Date of Patent: Oct. 1, 1996

[54] FLOW CONTROL SYSTEM AND METHOD

[75] Inventors: Clark E. Harris, Fairport; Joseph A. Manico, Rochester; Mari-Kim Cooke, Fairport; Jerry Carmen, Spencerport, all of N.Y.

[73] Assignee: Eastman Kodak Company, Rochester, N.Y.

[21] Appl. No.: 220,986

[22] Filed: Mar. 31, 1994

[51] Int. Cl.[6] ..... B65B 1/04; B65B 3/00

[52] U.S. Cl. ..... 141/346; 141/351; 141/353; 137/614.04; 222/105

[58] Field of Search ..... 141/346, 348, 141/349, 350, 351, 352, 353, 354, 355, 360, 362, 363, 364, 365, 366, 368, 369, 370, 375; 137/614.04; 222/105; 604/416

[56] References Cited

U.S. PATENT DOCUMENTS

| | | | |
|---|---|---|---|
| 497,896 | 5/1893 | Ruppel . | |
| 2,401,674 | 6/1946 | Vizay | 284/18 |
| 3,343,718 | 9/1967 | Siegel et al. | 141/349 |
| 3,698,454 | 10/1972 | Cunha et al. | 141/375 |
| 3,858,229 | 12/1974 | Stievenart et al. | 354/331 |
| 4,421,146 | 12/1983 | Bond et al. | 141/349 |
| 4,750,647 | 6/1988 | Cohen | 222/105 |
| 4,763,683 | 8/1988 | Carmack | 141/346 |
| 4,874,023 | 10/1989 | Ulm | 141/346 |
| 4,958,666 | 9/1990 | Kocourek et al | 141/114 |
| 4,991,635 | 2/1991 | Ulm | 141/346 |
| 5,031,676 | 7/1991 | Ulm | 141/346 |
| 5,070,351 | 12/1991 | Vanover et al | 354/299 |
| 5,150,811 | 9/1992 | Kelston | 222/105 |
| 5,179,982 | 1/1993 | Bérubeé et al. | 222/105 |

FOREIGN PATENT DOCUMENTS

| | | | |
|---|---|---|---|
| 0130853 | 1/1985 | European Pat. Off. . | |
| 0500371A2 | 2/1992 | European Pat. Off. | G03D 3/06 |
| 2263155 | 7/1993 | United Kingdom . | |

*Primary Examiner*—Henry J. Recla
*Assistant Examiner*—Steven O. Douglas
*Attorney, Agent, or Firm*—Charles E. Snee, III

[57] ABSTRACT

Flow control system (10) for controlling the flow between first and second containerized systems (12,14) has a first flow control member (20) positioned in the first containerized member (12) for cooperating with a second flow control member (22) positioned in the second containerized system (14). The first flow control member (20) has a fluid flow channel (28) in fluid communication with a proboscis member (50) having a through channel (58) in the second flow control member (14). Displacement of the flow control members (20,22) toward and away from one another enables the proboscis member (50) to open and, alternatively, close communicating fluid flow channels connecting the first and second containerized systems (12,14), without apparent leakage.

22 Claims, 8 Drawing Sheets

FIG. 5
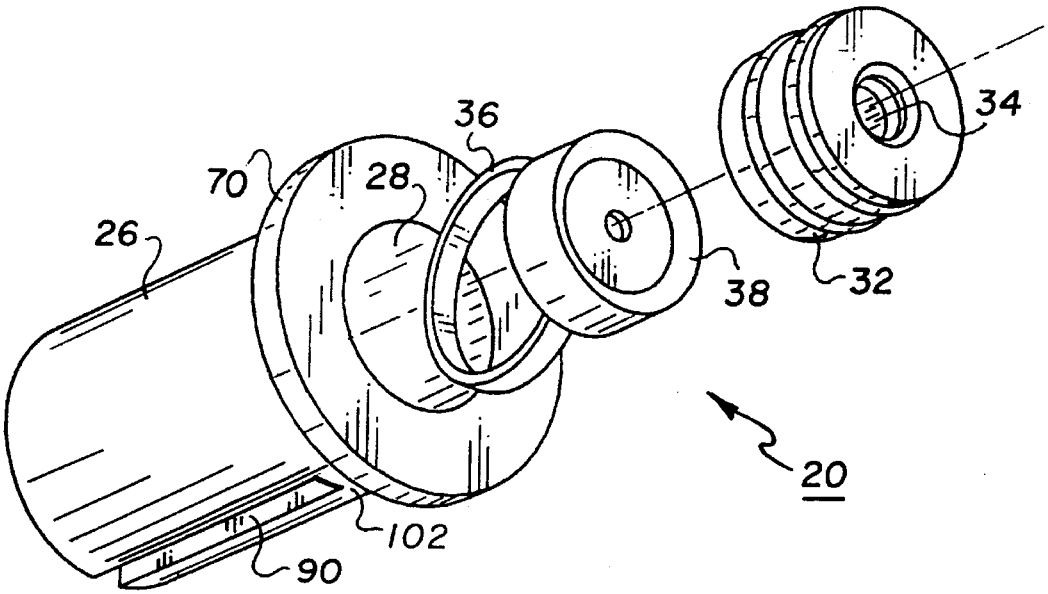
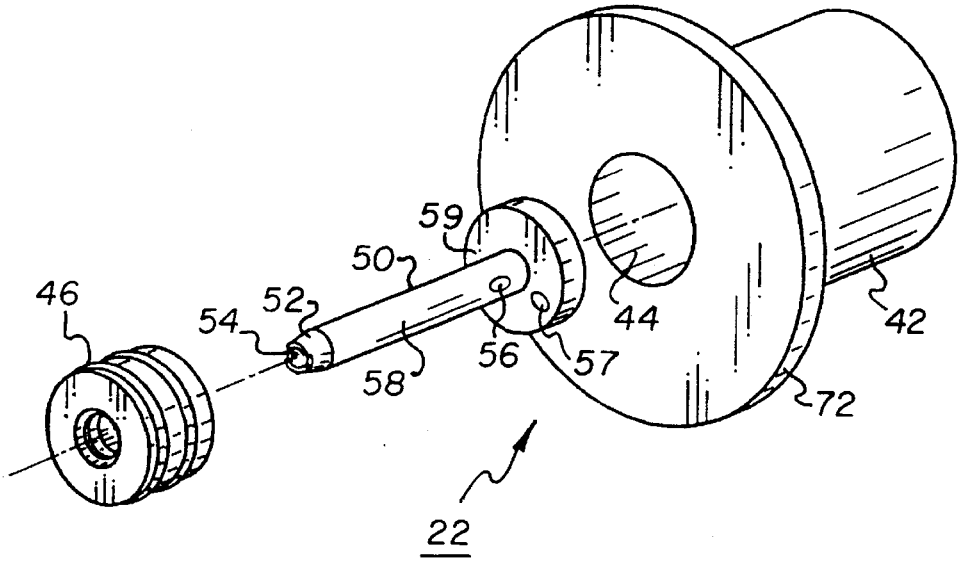
FIG. 6

FLOW CONTROL SYSTEM AND METHOD

FIELD OF THE INVENTION

The present invention relates to a flow control system and method. More particularly, the invention concerns a method and system for controlling the flow of fluid between mating containerized systems, such as a chemical replenishment container and a photoprinting machine, substantially without leaking and exposing the user to such fluid.

BACKGROUND OF THE INVENTION

Flow control devices, such as valves, are widely known to be used for regulating the flow of materials, primarily fluids, from one containerized system to another.

A conventional way to supply a fluid material to a containerized system, such as photoprinting machine, involves dispensing the fluid material from a receptacle, for example a flexible container, into a fluid reservoir or distribution channel in the photoprinting machine. The flexible containers or bottles currently used to replenish chemicals in these machines require that the user first open the container and then pour the contents into the photoprinting machine. One problem that results during the transfer of the chemicals is leakage. Chemical leakage, of course, exposes the operator to potential hazardous effects. Moreover, materials waste, and unnecessary expense, are related problems that persist with existing flow control systems. These shortcomings necessitate a need for an improved flow control system and method which can supply materials, such as photographic chemicals, to photoprinting machines, and the like, in a containerized system without leakage. Such systems would then present to the operator as a dripless or dry transfer system.

Consequently, it is necessary in the prior art to provide an apparently dry system for transferring materials between containerized systems. Preferably, in this system, a flow control or valving arrangement which communicates with both containerized systems (e.g., the flexible container for photographic chemicals and the photoprinting machine) is utilized such that when one containerized system is removed from the other, the valve would close and the user would not be exposed to leakage.

In U.S. Pat. No. 4,958,666 to Kocourek et al., a storage canister for process fluids includes a receptacle having leakage proof pouches of elastic material each having an opening closed by a control valve. The normally closed controlled valve is activated by suction or by over-pressure from suction or pressure devices in the processing apparatus.

SUMMARY OF THE INVENTION

It is, therefore, an object of the invention to provide a flow control system that eliminates leakage during fluid transfer between mating containerized systems.

Another object of the invention is to provide a flow control system for controlling the supply of a fluid to a containerized system without the user having to first open the containerized system prior to transferring the fluid into another containerized system.

Still another object of the present invention is to provide a flow control system for controlling the supply of a fluid from a first to a second containerized system such that when it is desired to remove the first containerized system from the second containerized system, no fluid is leaked during the process.

Another object of the invention is to provide a flow control system that can open and close a flow path between mating containerized systems without leakage.

Yet another object of the invention is to provide a method for transferring fluids between mating containerized systems without leakage and waste of the transferred material.

Accordingly, for accomplishing these and other objects of the invention, there is provided a flow control system for controlling the flow of fluid between first and second containerized systems. The first and second containerized systems include first and second openings, respectively. The flow control system comprises a first flow control member positioned at the first opening of the first containerized system. First flow control member has a first body member, a first fluid flow channel, a first seal having a first opening therethrough arranged in the first fluid flow channel, a fluid entrance port in fluid communications with the first fluid flow channel, a spring member retained in the first fluid flow channel, and a piston member normally biased by the spring against the first seal to close the first fluid channel.

Further, the flow control system includes a second flow control member positioned at the second opening. Second flow control member comprises a second body member having a second fluid flow channel, a second seal having a second opening therethrough arranged in the second fluid flow channel, and a proboscis member slidable axially in the second opening of the second seal and in the first opening of the first seal, the proboscis member having an open end portion, and at least one exit port on the opposite end within the second body member, and a through channel extending from the open end to the exit port.

In this embodiment of the invention, when the first opening of the first containerized system is urged toward the second opening of the second containerized system, the proboscis member partially withdraws from the second seal into the second body member and penetrates the first opening of the first seal. The open end portion of the proboscis member engages and displaces the piston member into deforming contact with the spring member thereby positioning the entrance port in fluid communication with the through channel of the proboscis member.

Moreover, when the first opening of the first containerized system is urged into proximate contact with the second opening of the second containerized system, the proboscis member withdraws through the second opening of the second seal and comes to rest in the second housing, thereby enabling an open fluid flow path from the entrance port, through the open end of the proboscis member, through the through channel of the proboscis member, through the exit port, and to the fluid inlet channel of the second containerized system.

Finally, when the first opening of the first containerized system is urged away from the second opening of the second containerized system, the proboscis member partially withdraws from the first opening of the first seal and away from the piston member thereby allowing the piston member to seal against the first seal, and sequentially the exit port of the proboscis member is positioned in sealing relation with the second seal, thus closing the open fluid flow path between the first and second containerized system.

Another solution to one or more of the above problems is provided by a flow control system for adjoining first and second containerized systems, the first containerized system having a first opening and the second containerized system having a second opening. In this embodiment, the flow control system comprises the first and second fluid flow members, as described above. Moreover, the fluid flow members communicate and operate in the manner described previously.

Yet another solution to one or more of the above problems is provided by a flow control system for controlling the flow of fluid between first and second containerized systems, the first containerized system having a first opening, and the second system having a second opening. The flow control system comprises first and second flow control members as described above.

In this embodiment of the invention, when the first opening of the first containerized system is urged toward the second opening of the second containerized system, the proboscis member partially withdraws from the second seal, and penetrates the first opening of the first seal. The open end portion of the proboscis member engages and displaces the piston member into deforming contact with the spring member thereby positioning the entrance port in fluid communication with the through channel of the proboscis member. The proboscis member withdraws through the second opening of the second seal and comes to rest in the second body member, thereby enabling an open fluid flow path from the entrance port, through the open end of the proboscis member, through the through channel of the proboscis member, through the exit port, and to the fluid inlet channel of the second containerized system.

Further, when the first opening of the first containerized system is urged away from the second opening of the second containerized system, the proboscis member partially withdraws from the first opening of the first seal and away from the piston member thereby allowing the piston member to seal against the first seal. The exit port of the proboscis member is positioned in a sealing relation with the second seal, thus closing the open fluid flow path between the first and second containerized systems.

The method of the invention is for controlling fluid flow from a first containerized system having an openable end portion, to a second containerized system having a fluid inlet channel. The method comprises the step of providing a first flow control member, as previously described, positioned in the openable end portion of the container and providing a second flow control member, as described above, positioned in the fluid inlet channel of the second containerized system. A second face flange of the second flow control member is urged onto a first face flange of the first flow control member so that the proboscis member at least partially engages the first seal and displaces the piston toward the spring mender thereby opening a first flow path extending between the entrance port, the opening of the proboscis member, and through the through channel of the proboscis member. The second face flange of the second flow control member is urged into proximate contact with the first face flange of the first flow control member thereby opening a second fluid flow path extending from the entrance port, to the opening and through channel of the proboscis member, through the exit port of the proboscis member and terminating in the inlet channel of the second containerized system. When it is desired to terminate the flow between the first and second containerized systems, the second face flange of the second flow control member is urged away from the first face flange of the first flow control member, thereby closing the first and second flow paths between the entrance port and the proboscis member and the exit port and the inlet channel, respectively.

Accordingly, advantageous effects of the present invention are that it provides flow control systems and a method for controlling the flow of fluids between mating containerized systems without leakage, that are simple to operate, easy to manufacture, and inexpensive to produce.

BRIEF DESCRIPTION OF THE DRAWINGS

The foregoing as well as other objects, features and advantages of this invention will become more apparent from the appended Figures, wherein like reference numerals denote like elements, and wherein:

FIG. 5 is an exploded perspective view of the first flow control member;

FIG. 6 is an exploded perspective view of the second flow control member;

DETAILED DESCRIPTION OF THE INVENTION

Figure 1:
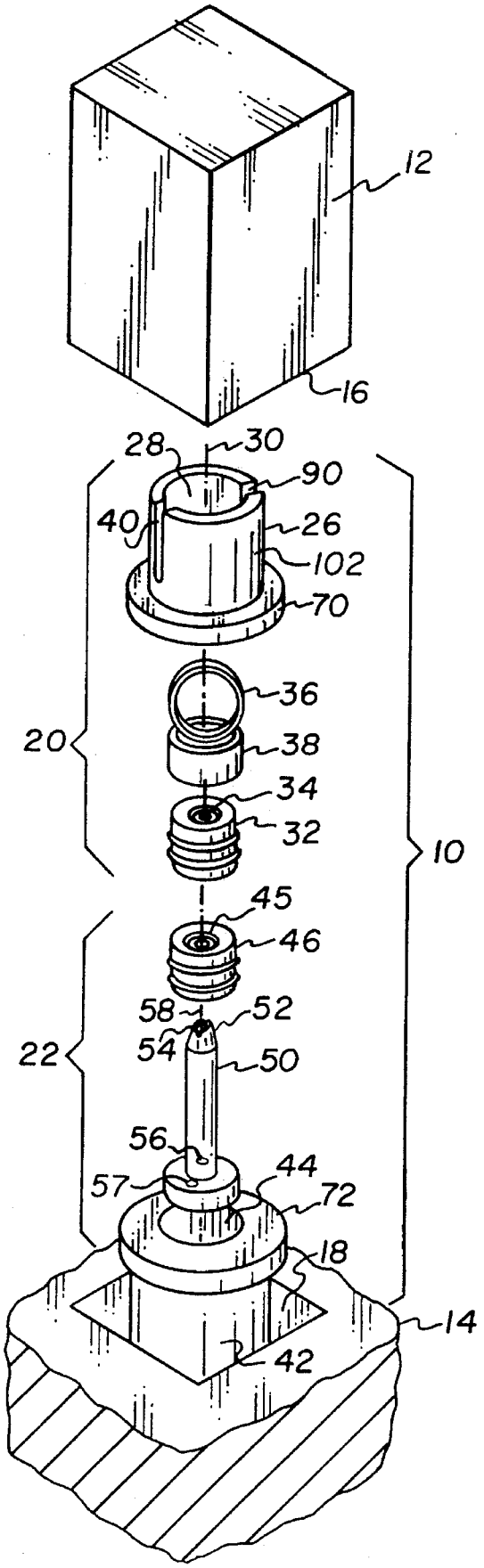
FIG. 1 is an exploded perspective view of the flow control system according to the invention.

Turning now to the drawings, and more particularly to FIG. 1, a flow control system 10 is illustrated for controlling the flow of fluids between mating first and second containerized systems 12,14. The first containerized system 12 has a first opening 16, and the second containerized system 14 includes a second opening 18, each for containing members of the flow control system 10. In a particular embodiment of the invention, the first containerized system 12 may be any sort of fluid container, such as a cartridge, bag-in-a-box or bottle; and, the second containerized system may be a fluid replenishable machine, such as a photoprinting machine, or copier. Therefore, broadly defined, flow control system 10 comprises a first flow control member 20 positioned at the first opening 16 of the first containerized system 12; and, a second flow control member 22 positioned at the second opening 18 of the second containerized system 14.

In FIGS. 1–5, first flow control member 20 is shown to include a first body member 26, a first fluid flow channel 28 passing through a central portion 30 of the body member 26, a fluid entrance port 33 in fluid communication with the flow channel 28, and a first seal 32 having a first opening 34 therethrough arranged in the first fluid flow channel 28. Moreover, as best seen in FIG. 5, a first biasing means, preferably an annular spring 36, is retained in the first fluid flow channel 28, normally biasing a valve member such as a piston 38 against the first seal 32 to close the first fluid flow channel 28 when desired. Moreover, in FIGS. 2–4, annular spring 36 is shown providing support for piston member 38 against first seal 32, thereby preventing fluid from escaping the first containerized system 12.

Referring again to FIGS. 1–4, and 6, second flow control member 22 which cooperates with the first control member 20, is positioned in the second opening 18 of the second containerized system 14. The second flow control member 22 comprises a second body member 42 having a second fluid flow channel 44, a second flexible seal 46 arranged in the second fluid flow channel 44, a shoulder portion 48 positioned within channel 44 beyond the second flexible seal 46, and a displaceable proboscis member 50. As best illustrated in FIG. 6, the proboscis member 50 has an open end 52 and a notched portion 54 surrounding the open end 52 which projects outwardly of the second body member 42. Further, proboscis member 50 includes at least one radial exit port 56, a through channel 58 extending from the open end 52 to the exit port 56, and an integral or attached stop member 59 positioned beyond the exit port 56 for contacting the shoulder portion 48 of the second housing 42. An axial bore 57 is provided through stop member 59.

Figure 2:
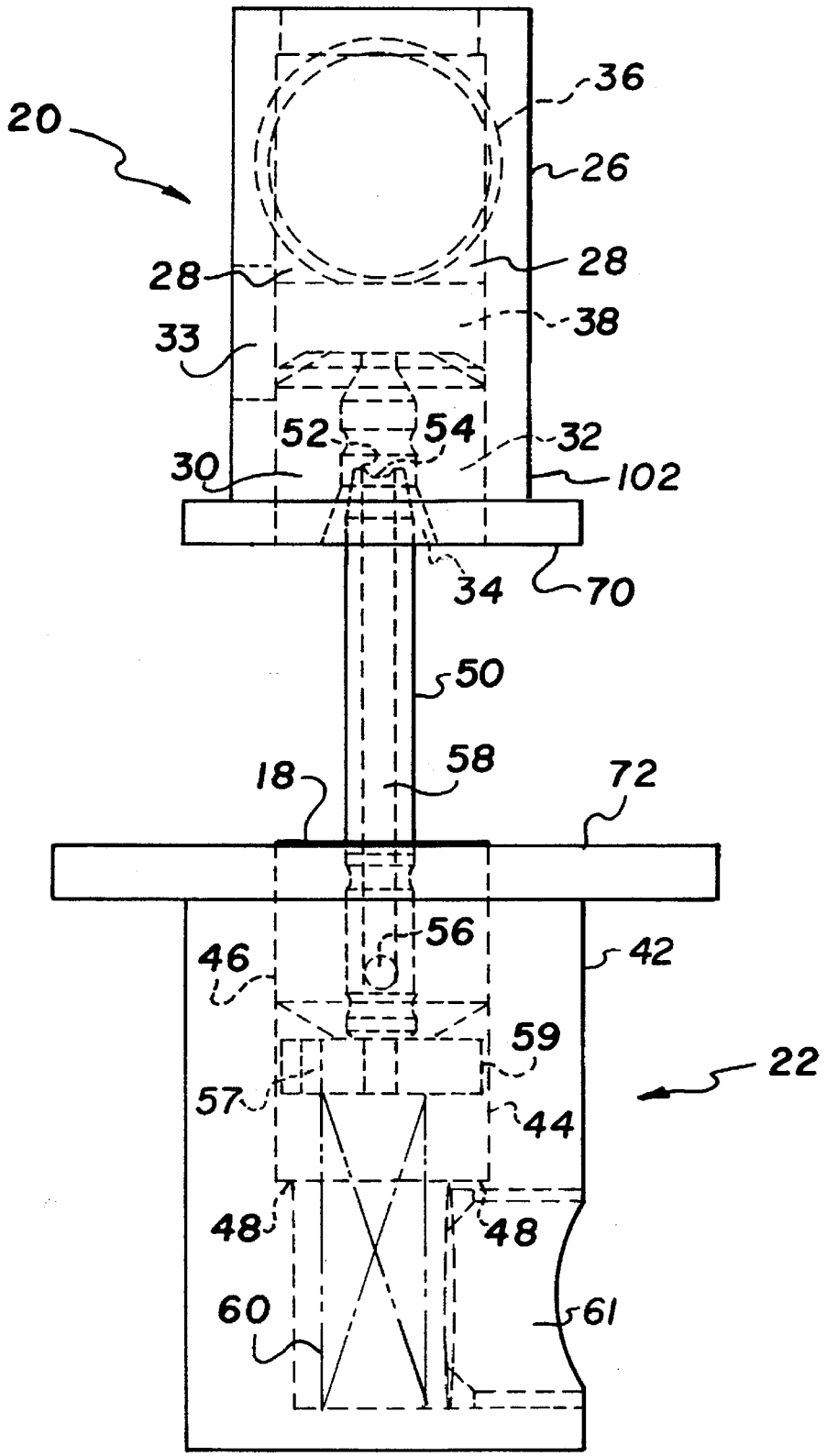
FIG. 2 is a sectional view of the first and second flow control members with the proboscis member of the second flow control member just entering the first control member.
Figure 3:
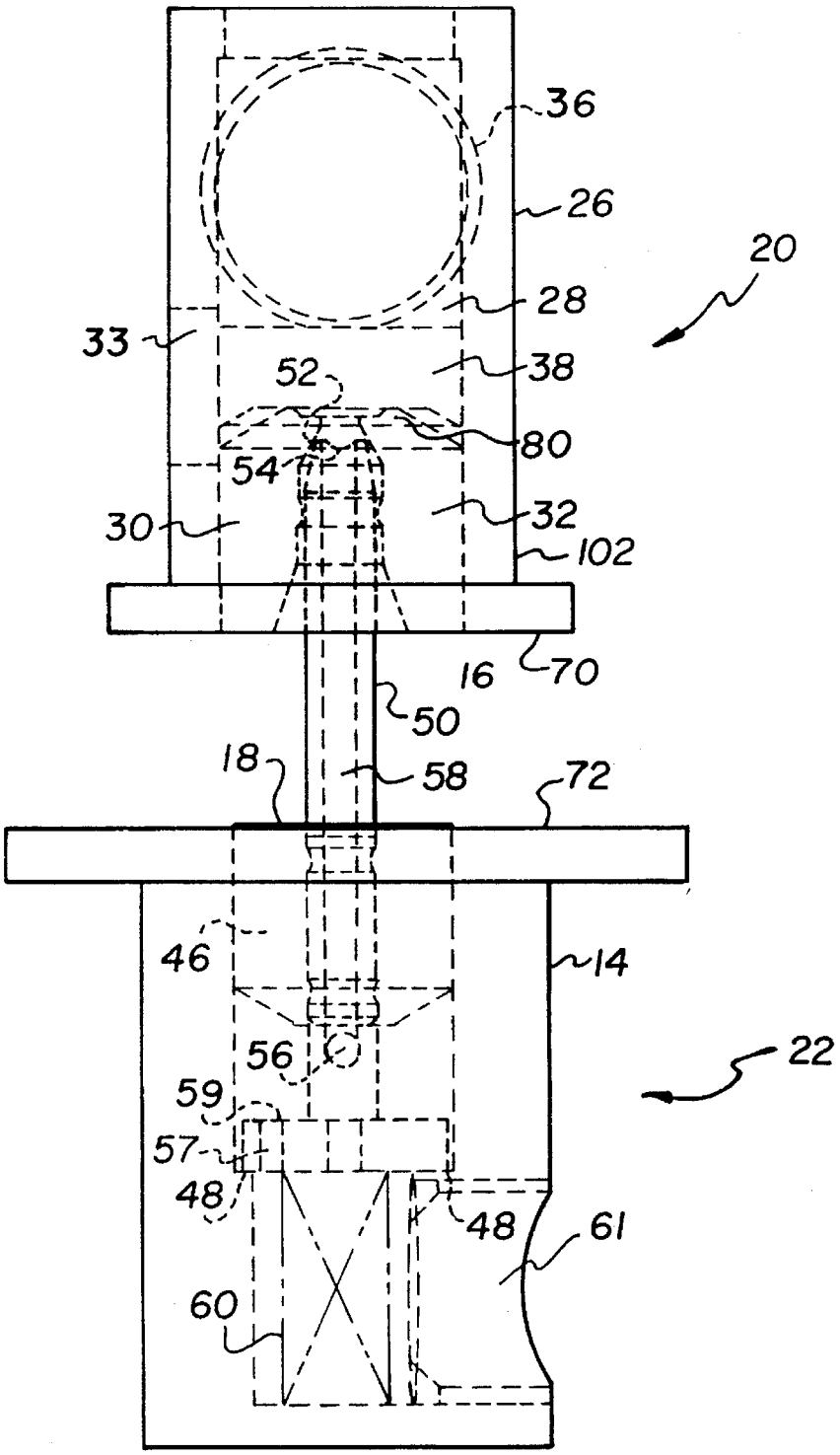
FIG. 3 is a sectional view of both flow control members with the proboscis member of the second flow control member open.
Figure 4:
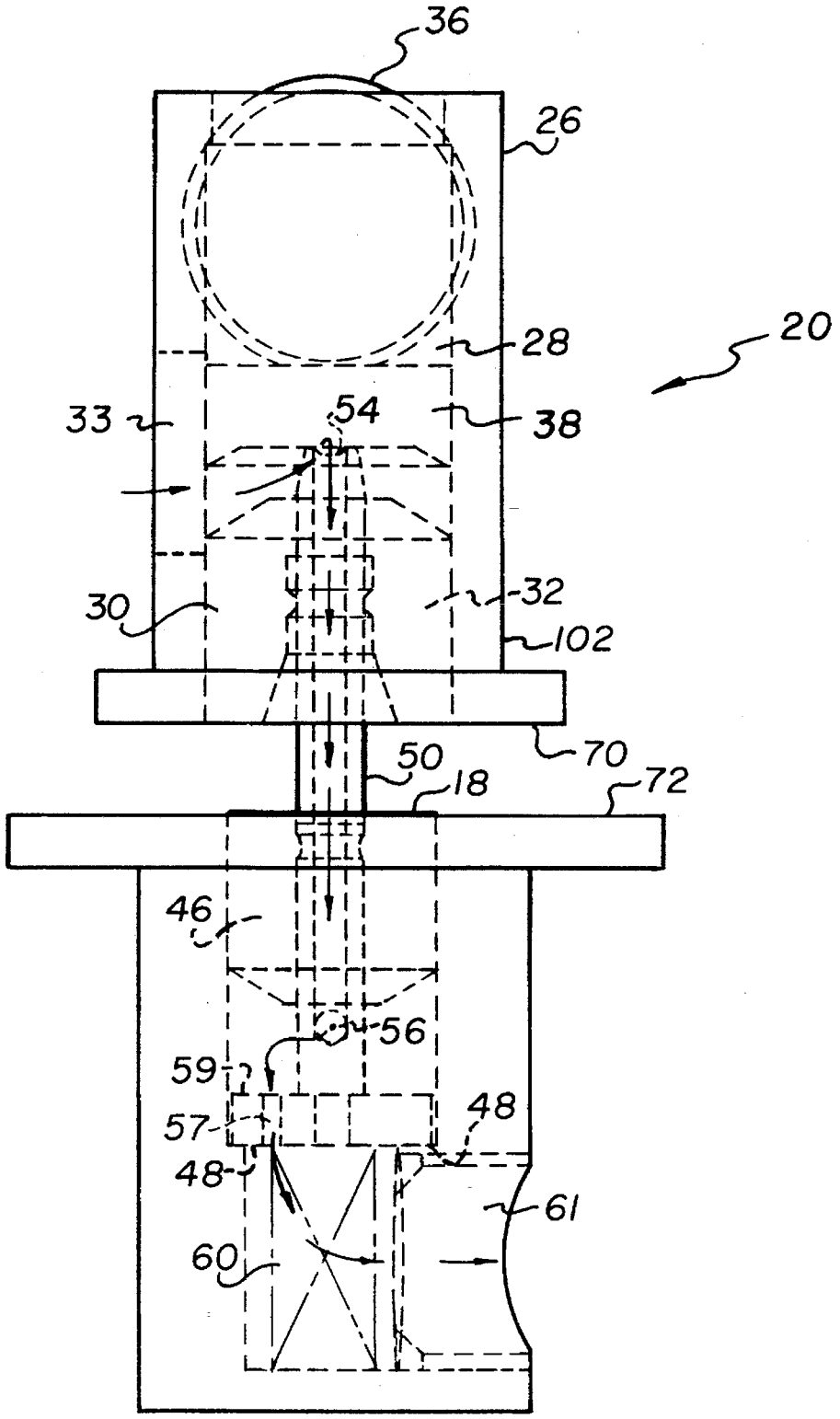
FIG. 4 is a sectional view of both flow control members with the proboscis member fully communicating with the first flow control member, thereby opening a fluid flow path between both control members.

FIGS. 2–4 show the first flow control member 20 in the first containerized system 12 engaging the proboscis member 50 of the second flow control member 22. According to FIG. 4, when the two flow control members 20,22 are in proximate contact, the proboscis member 50 remains inserted in the second seal 46 and is trapped in the second body member 42 by the second seal 46. The second seal 46 is held flush mounted in the second body member 42 by an adhesive. As indicated below, the proboscis member 50 is sized for passing into and through opening 34 of the first seal 32 within the flow control member 20.

Again turning to FIGS. 2–4, a second biasing member, i.e. second spring 60, engages stop member 59 to force proboscis member 50 forward to seal against the second seal 46, thus preventing fluid from escaping the second containerized system 14 or photoprinting machine when the first containerized system 12 is not present.

Although not required in the preferred embodiment of the invention, as depicted in FIGS. 1–4, first body member 26 of the first flow control member 20 may be provided with a first face flange 70; and, the second body member 42 of the second flow control member 22 may be provided with second face flange 72. Face flanges 70,72 facilitate operation of the flow control system 10, as described in detail below.

Figure 7:
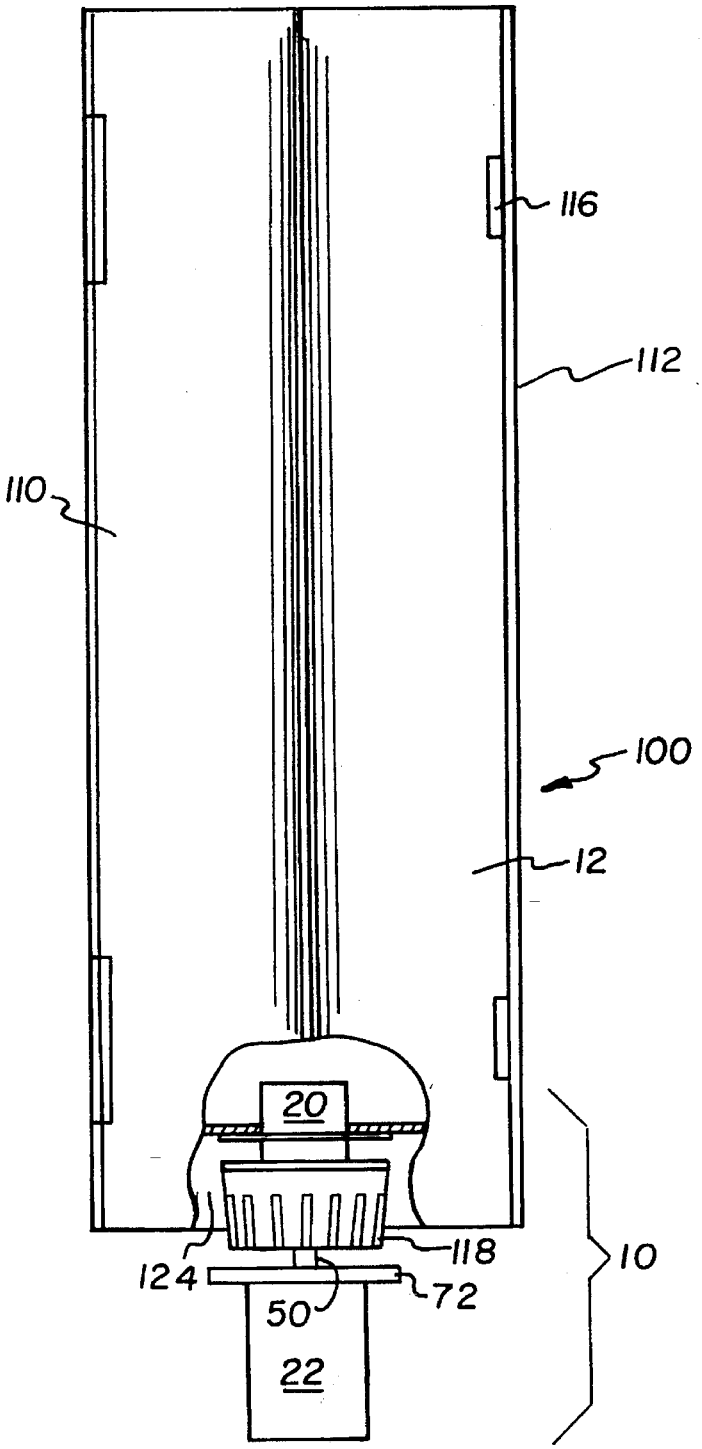
FIG. 7 is a side view of fluid supply container and communicating flow control members therein.
Figure 8:
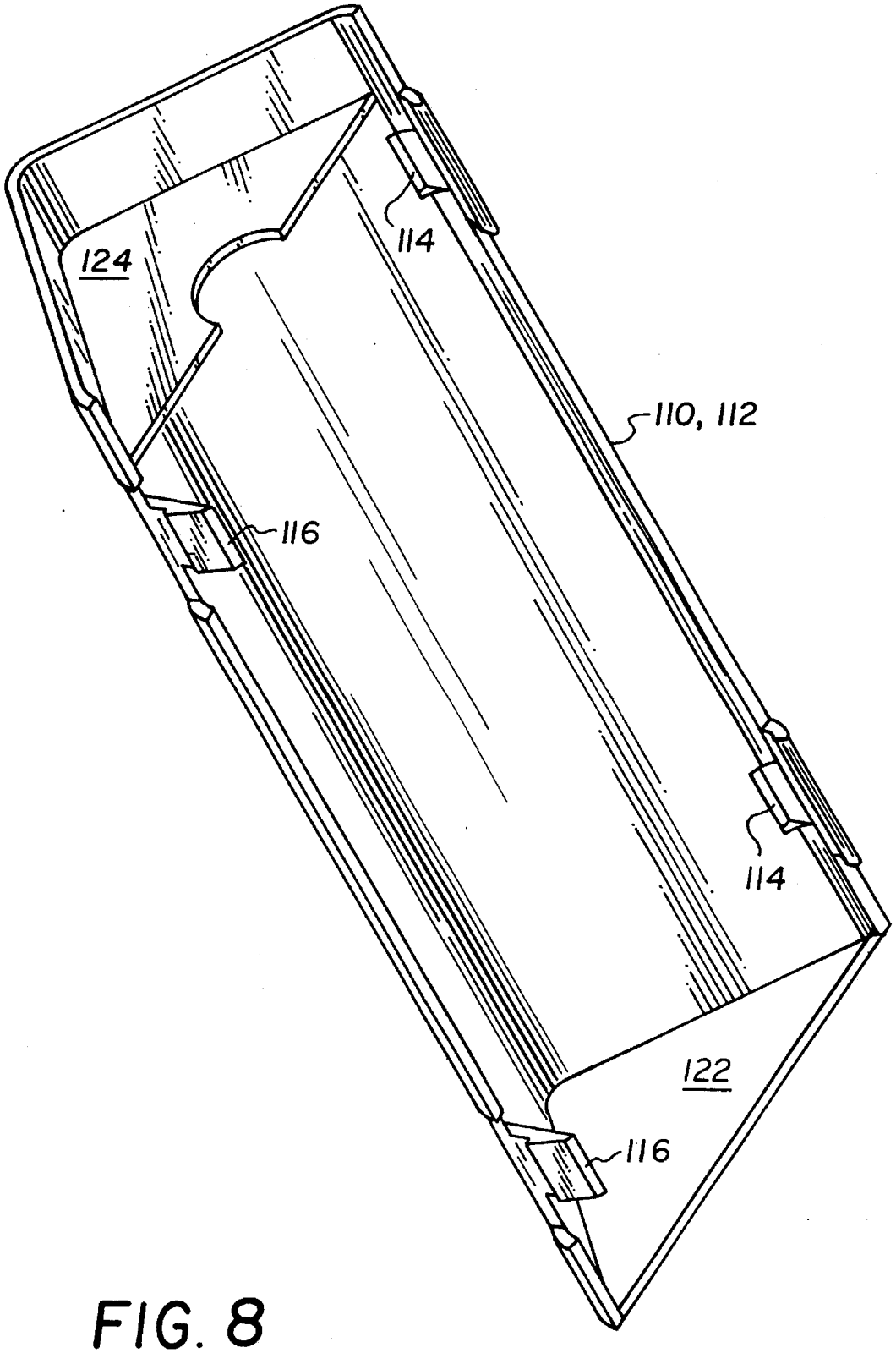
FIG. 8 is an isometric view of a half portion of a housing assemblage for enclosing a containerized system; and, FIG. 9 is an isometric view of an assembled housing for one containerized system.
Figure 9:
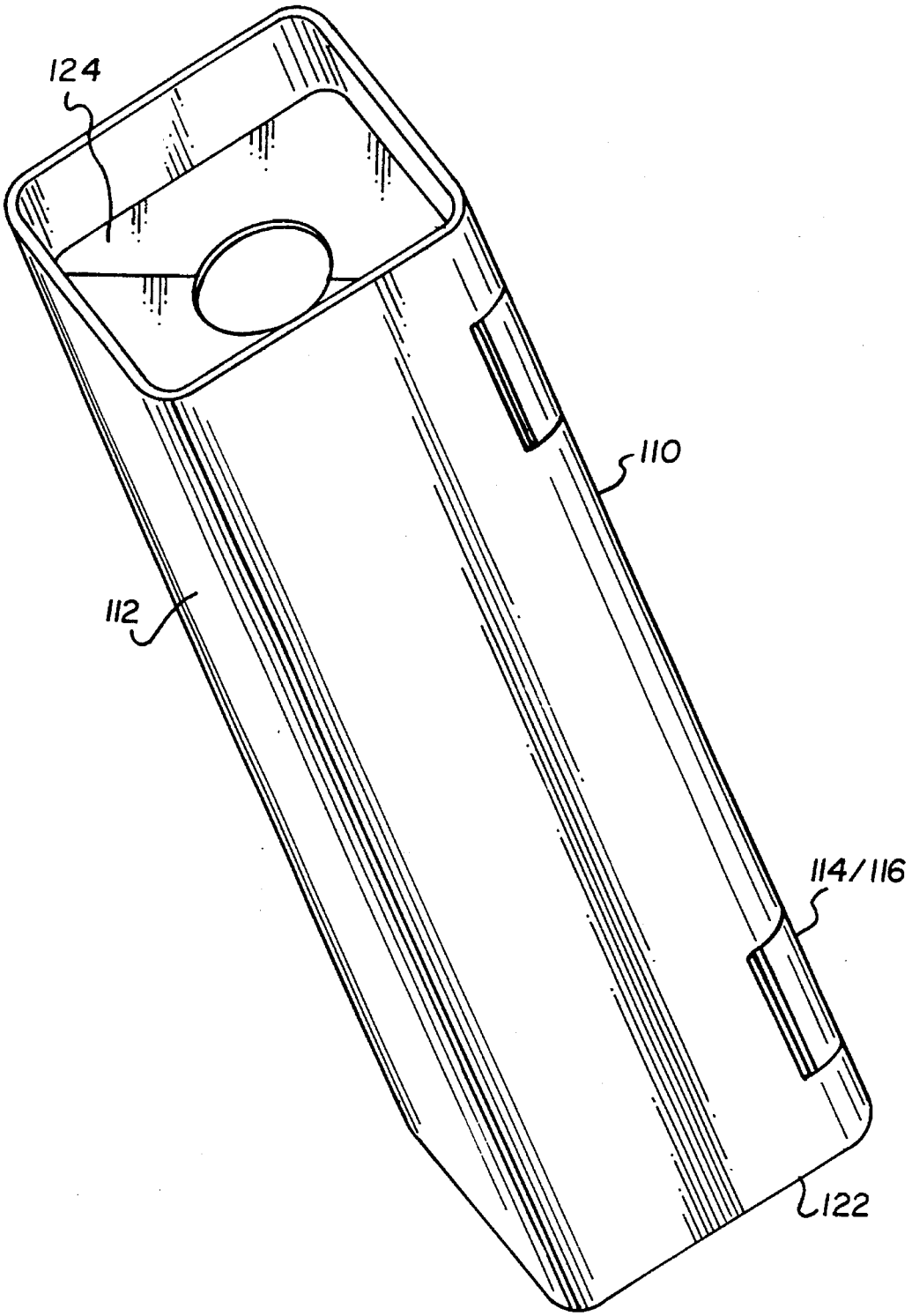

In FIGS. 7–9, alternatively, rigid housing assemblage 100 may enclose the first containerized system 12. Housing assemblage 100 comprises first and second half portions 110,112, each having a plurality of opposed slots 114 and snaps 116 for interlocking the first half portion 110 to the second half portion 112. Thus, when the two half portions 110,112 are assembled, the snaps 116 of one fit snugly in the slots 114 of the other, thereby securely interlocking the half portions together. Interlocked half portions 110,112 are formed having a closed end portion 122 and a partially opened end portion 124 for receiving and passing the necked down portion 102 of the first containerized system 12, for example, a plastic bag attached to portion 102, not illustrated. According to FIG. 7, flow control system 10, as described above, may comprise a cap 118 engaged with face flange 70 of the first containerized system 12 to retain the fluids therein before engagement with the second containerized system 14.

According to FIG. 7, the housing assemblage 100 enclosing first containerized system 12 is mateable onto the photoprinting machine or second containerized system 14 in an inverted position. Cap 118 and first flow control member 20 are positioned at the bottom of the first containerized system 12 when inverted for fluid transfer between the two containerized systems 12,14. As illustrated in FIG. 1, second containerized system 14 contains the second flow control member 22 having proboscis member 50 projecting upwardly toward the first flow control member 20 positioned in the first containerized system 12.

Accordingly, in a preferred embodiment of invention, when transferring a fluid from one containerized system to the other, the first opening 16 of the first containerized system 12, for example plastic bag containing photographic chemicals, is urged toward the second opening 18 of the second containerized system 14. Alternatively, the first face flange 70 of the first body member 26 can be urged toward the second face flange 72 of the second body member 46 to achieve the same result. In either instance, the proboscis member 50 engages first seal 32, partially withdraws through the second seal 46 toward the shoulder 48, and penetrates the first opening 34 of the first seal 32. The open end portion 52 of the proboscis member 50 engages and displaces the piston member 38 into deforming contact with the annular spring 36, thereby placing the entrance port 33 in fluid communication with notches 54, open end 52 and through channel 58 of the proboscis member 50.

Further, when the first opening 16 of the first containerized system 12 is urged into proximate contact with the second opening 18 of the second containerized system 14 or photoprinting machine, the proboscis member 50 withdraws through a second opening 45 of the second seal 46 and comes to rest on the shoulder 48. A fluid flow path is thereby opened from the entrance port 33, through the open end 52 of the proboscis member 50, through the through channel 58 of the proboscis member 50, through the exit port 56, through axial bore 57 and to the fluid inlet channel 61 of the second containerized system 14.

Furthermore, as illustrated in FIGS. 2–4, to terminate the flow of fluid between the first and second containerized systems 12,14, the first flow control member 20 of the first containerized system 12 is urged away from the second flow control member 22 of the second containerized system 14, as described in detail above. As indicated, the proboscis member 50 partially withdraws from the first opening 34 of the first seal 32 and away from the piston member 38 thereby allowing the piston member 38 to seal against the first seal 32. Sequentially, the exit port 56 of the proboscis member 50 is positioned in sealing within bore 45 of the second seal 46, thus closing the open fluid flow path between the first and second containerized systems 12,14.

In an alternative embodiment of the invention, when transferring a fluid from one containerized system to another (as shown in FIGS. 2–4), the first opening 16 of the first containerized system 12 is urged toward the second opening 18 of the second containerized system 14, the proboscis member 50 partially withdraws from the second seal 46 toward the shoulder portion 48, and penetrates the first opening 34 of the first seal 32. The open end portion 52 of the proboscis member 50 engages and displaces the piston member 38 into deforming contact with the spring member 36 thereby positioning the entrance port 33 in fluid communications with the through channel 58 of the proboscis member 50. The proboscis member 50 withdraws through the second opening 45 of the second seal 46 and comes to rest on the shoulder portion 48 in the second body member 46, thereby enabling an open fluid flow path from the entrance port 33, through the open end 52 of the proboscis member 50, through the through channel 58 of the proboscis member 50, through the exit port 56, through axial bore 57 and to the fluid inlet channel 61 of the second containerized system 14.

As above, when it is desired to terminate flow between the containerized systems 12,14, the first opening 16 of the first containerized system 12 is urged away from the second opening 18 of the second containerized system 14. The proboscis member 50 partially withdraws from the first opening 34 of the first seal 32 and away from the piston member 38 thereby allowing the piston member 38 to seal against the first seal 32. The exit port 56 of the proboscis member 50 is positioned in sealing relation within bore 45 of the second seal 46, thus closing the open fluid flow path between the first and second containerized systems 12,14.

In yet another embodiment of the invention, a method for controlling fluid flow from a first containerized system 12 having a first opening 16, to a second containerized system 14 having a second opening 18, comprises the step of providing first and second flow control members 20,22 positioned in the openings of the containerized systems, as described in details above (FIG. 1). The first opening 16 of the first containerized system 12 is urged toward the second opening 18 of the second containerized system 14 so that the proboscis member 50 of the second flow control member 22 at least partially penetrates the first opening 34 of the first flexible seal 32, and subsequently engages and then displaces the piston member 38 toward the spring member 36 thereby opening a first flow path extending between the entrance port 33, the opening 52 of the proboscis member 50, and through the through channel 58 of the proboscis member 50. Further, the first opening 16 of the first containerized system 12 is urged into proximate contact with the second opening 18 of the second containerized system 14. When the two containerized systems 12,14 are in proximate contact, a second fluid flow path is opened extending from the entrance port 33, to the opening 52 and through channel 58 of the proboscis member 50, through the exit port 56 of the proboscis member 50, through axial bore 57 and terminating in the second fluid flow channel or inlet channel 61 of the second containerized system. When it is desired to terminate fluid flow between the two containerized systems 12,14, the second opening 18 of the second containerized system 14 is urged away from the first opening 16 of the first containerized system 12 thereby closing the first fluid flow path and the second fluid flow path.

The flow control system 20 may also include the step of providing an O-ring 80 supported on the first seal 32 for sealing between first seal 32 and piston member 36 against leakage. This is shown schematically in FIG. 3. The advantage of the O-ring 80 is that it provides additional positive sealing of the open end of orifice 52 surrounding the through channel 58 of the proboscis member 50 against leakage.

Moreover, according to FIGS. 1 and 5, the method of the invention may alternatively include the step of providing a spring retaining slot 90 in the interior walls of the first body member 26 of the first containerized system to retain the spring member when deformed by the piston. The spring retaining slot 90 preferably extends along a circumferential portion of the wall of the first body member 26.

To use the flow control systems 10 of present invention, the operator places the first containerized system 12 onto the second flow control system 22 positioned in the second opening 18 of the machine or second containerized system 14 (See FIGS. 1–4). As described above, the first and second flow control members 20,22 are positioned in fluid communications with one another so that a flow path between them can be alternatively opened and closed as described. Thus, as the proboscis member 50 of the second containerized system 14 penetrates the first seal 32 of the first flow control member 20, it is forced to retract in the second flow control member 22 by an amount approximately equal to the travel distance of the proboscis member 50. This action opens the fluid path in the second flow control member 22 but does not open any fluid path to the atmosphere (see FIG. 4). Next the proboscis member 50 is displaced farther into contact with the piston member 38 of the first flow control member 20 and continues to force the piston member away from the first seal 32. This action opens the fluid path of the first flow control member 20 and fluid can now flow into or out of the second containerized system 14 or machine from the bottle or first containerized system 12.

As indicated, the fluid passes from the bottle or first containerized system 12 into the first flow control member 20 through the first body member 26. It then enters the opening 52 in the end of the proboscis member 50 and passes through the through channel 58 and out the side hole or exit port 56 in the proboscis member 50. After exiting the proboscis member 50, the fluid then passes through axial bore 57 and enters the inlet channel 61 of the second containerized system 14 thereby replenishing the second containerized system 14 with the fluid.

Removal of the first containerized system 12 from the machine or second containerized system 14 reverses the above action of the flow control members 20,22 and the liquid is not exposed to the customer using the machine. Thus, a dry fluid flow system is perceived by the customer.

The invention has therefore been described with reference to certain embodiments thereof, but it will be understood that variations and modifications can be effected within the scope of the invention.

| | Parts List |
|---|---|
| Flow Control System | 10 |
| First Containerized System | 12 |
| Second Containerized System | 14 |
| First Opening | 16 |
| Second Opening | 18 |
| First Flow Control Member | 20 |
| Second Flow Control Member | 22 |
| First Housing or Body Member | 26 |
| First Fluid Flow Channel | 28 |
| Central Portion | 30 |
| First Seal | 32 |
| Fluid Entrance Port | 33 |
| First Opening | 34 |
| Annular Spring | 36 |
| Valve Member | 38 |
| Second Housing or Body Member | 42 |
| Second Opening | 45 |
| Second Fluid Flow Channel | 44 |
| Second Opening | 45 |
| Second Flexible Seal | 46 |
| Shoulder Portion | 48 |
| Proboscis Member | 50 |
| Open End | 52 |
| Notched Portion | 54 |
| Axial Bore | 57 |
| Exit Port | 56 |
| Stop Member | 59 |
| Channel | 58 |
| Spring Member | 60 |
| Fluid Inlet Channel | 61 |
| First Face Flange | 70 |
| Second Face Flange | 72 |
| O-ring | 80 |
| First Rigid Housing Assemblage | 100 |
| Neck Down Portion | 102 |
| First Half Portion | 110 |
| Second Half Portion | 112 |
| Opposed Slots | 114 |
| Snaps | 116 |
| Cap | 118 |

-continued

| | Parts List |
|---|---|
| Closed End Portions | 122 |
| Partially Opened End Portion | 124 |

We claim:

1. A flow control system for controlling the flow of fluid between first and second systems, said first system having a first opening, and said second system having a second opening, said flow control system comprising:

a first flow control member adapted to be positioned in said first opening, said first flow control member comprising a first body member, a first fluid flow channel through said first body member, a first seal having a first opening therethrough arranged in said first fluid flow channel, a fluid entrance port through said first body member in fluid communication with said first fluid flow channel, a first spring retained in said first fluid flow channel, and a valve member normally biased by said first spring against said first seal to close said first opening through said first seal;

a second flow control member adapted to be positioned in said second opening, said second flow control member comprising a second body member, a second fluid flow channel through said second body member, a second seal having a second opening therethrough arranged in said second fluid flow channel, a shoulder in said second fluid flow channel, a stop member slidable in said second fluid flow channel between said second seal and said shoulder, a proboscis member extended from said stop member away from said shoulder, said proboscis member being slidable axially in said second opening of said second seal and in said first opening of said first seal, said proboscis member having an open end portion extended on one side of said second seal, at least one exit port within said second body member, and a through channel extending from said open end portion to said exit port; and a second spring retained in said second fluid flow channel, said stop member normally being biased by said second spring to ward said second seal to close said exit port in a sealing relation with said second seal;

wherein, when said first opening of said first system is urged toward said second opening of said second system, said proboscis member partially withdraws into said second body member through said second seal and said stop member moves toward said shoulder; said proboscis member penetrates said first opening of said first seal; said open end portion of said proboscis member engages and displaces said valve member into deforming contact with said first spring thereby positioning said entrance port in fluid communication with said through channel;

wherein, when said first opening of said first system is urged into proximate contact with said second opening of said second system, said proboscis member withdraws further into said second body member through said second opening of said second seal and said stop member comes to rest on said shoulder in said second body member, thereby moving said exit port out of a sealing relation with said second seal and enabling an open fluid flow path from said entrance port, through said open end portion, through said through channel, through said exit port, and to a fluid inlet channel of said second system; and wherein, when said first opening of said first system is urged away from said second opening of said second system, said proboscis member partially withdraws from said first opening of said first seal and away from said valve member thereby allowing said valve member to seal against said first seal, and said exit port of said proboscis member to return to a sealing relation with said second seal, thus closing said open fluid flow path between said first and second systems.

2. The flow control system recited in claim 1 wherein said second flow control member confines said exit port within said second seal when said second fluid flow path is closed.

3. The flow control system recited in claim 1 wherein said first control member is positioned above said second flow control member.

4. The flow control system recited in claim 1 wherein said first and second seals are made of flexible materials.

5. The flow control system recited in claim 1 wherein said first seal is adhesively bonded within said first fluid flow channel.

6. The flow control system recited in claim 1 wherein said second seal is adhesively bonded within said second fluid flow channel.

7. The flow control system recited in claim 1 wherein an O-ring is supported on said first seal for sealing said first seal and valve member against leakage.

8. The flow control system recited in claim 1 wherein an opening is provided in said first fluid flow channel for retaining deformed portions of said first spring when said first spring has been engaged by said valve member.

9. The flow control system recited in claim 1 wherein said first system is positioned in a housing assemblage comprising first and second half portions, each having a plurality of opposed slots and snaps for interlocking said first half portion to said second half portion thereby forming interlocked half portions, said interlocked half portions defining a closed end portion and a partially opened end portion for receiving said first flow control member.

10. The flow control system recited in claim 9 wherein said first flow control member is trapped in said partially opened end portion.

11. A flow control system adjoining first and second systems, said first system having a first opening and said second system having a second opening, said flow control system comprising:

a first flow control member adapted to be positioned in said first opening, said first flow control member comprising a first body member, a first fluid flow channel through said first body member, a first seal having a first opening therethrough arranged in said first fluid flow channel, a fluid entrance port through said first body member in fluid communication with said first fluid flow channel, a spring retained in said first fluid flow channel, and a valve member normally biased by said spring against said first seal to close said first opening through said first seal;

a second flow control member adapted to be positioned in said second opening, said second flow control member comprising a second body member, a second fluid flow channel through said second body member, a second seal having a second opening therethrough arranged in said second fluid flow channel, a stop member slidable in said second fluid flow channel, and a proboscis member extended from said stop member and slidable axially in said second opening of said second seal and in said first opening of said first seal, said proboscis member having an open end portion extended from one side of said second seal, at least one exit port within said second body member, and a through channel extending from said open end portion to said exit port;

wherein, when said first opening of said first system is urged toward said second opening of said second system, said proboscis member partially withdraws into said second body member through said second seal and penetrates said first opening of said first seal, said open end portion of said proboscis member engages and displaces said valve member into deforming contact with said spring thereby positioning said entrance port in fluid communication with said through channel of said proboscis member;

wherein, when said first opening of said first system is urged into proximate contact with said second opening of said second system, said proboscis member withdraws further into said second body member through said second opening of said second seal and comes to rest in said second housing, thereby moving said exit port out of sealing contact with said second seal and enabling an open fluid flow path from said entrance port, through said open end portion, through said through channel, through said exit port, and to a fluid inlet channel of said second system; and wherein, when said first opening of said first system is urged away from said second opening of said second system, said proboscis member partially withdraws from said first opening of said first seal and away from said valve member thereby allowing said valve member to seal against said first seal, and said exit port of said proboscis member returns to sealing contact with said second seal, thus closing said open fluid flow path between said first and second systems.

12. A flow control system for controlling the flow of fluid between first and second systems, said first system having a first opening, and said second system having a second opening, said flow control system comprising:

a first flow control member adapted to be positioned in said first opening, said first flow control member comprising a first body member, a first fluid flow channel through said first body member, a first seal having a first opening therethrough arranged in said first fluid flow channel, a fluid entrance port through said first body member in fluid communication with said first fluid flow channel, a spring retained in said first fluid flow channel, and a valve member normally biased by said spring against said first seal to close said first opening through said first seal;

a second flow control member adapted to be positioned in said second opening, said second flow control member comprising a second body member, a second fluid flow channel through said second body member, a second seal having a second opening therethrough arranged in said second fluid flow channel, a stop member slidable in said second fluid flow channel, and a proboscis member extended from said stop member and slidable axially in said second opening of said second seal and in said first opening of said first seal, said proboscis member having an open end portion extended from one side of said second seal, at least one exit port within said second body member, and a through channel extending from said open end portion to said exit port;

wherein, when said first opening of said first system is urged toward said second opening of said second system, said proboscis member partially withdraws into said second body member through said second seal and penetrates said first opening of said first seal, said open end portion of said proboscis member engages and displaces said valve member into deforming contact with said spring thereby positioning said entrance port in fluid communication with said through channel of said proboscis member, and said proboscis member further withdraws through said second opening of said second seal and comes to rest in said second body member, thereby moving said exit port out of sealing contact with said second seal and enabling an open fluid flow path from said entrance port, through said open end portion, through said through channel, through said exit port, and to a fluid inlet channel of said second system; and wherein, when said first opening of said first system is urged away from said second opening of said second system, said proboscis member partially withdraws from said first opening of said first seal and away from said valve member thereby allowing said valve member to seal against said first seal, and said exit port of said proboscis member to return to sealing contact with said second seal, thus closing said open fluid flow path between said first and second systems.

13. The flow control system recited in claim 12 wherein said second flow control member confines said exit port within said second seal when said second fluid flow path is closed.

14. The flow control system recited in claim 12 wherein said first control member is positioned above said second flow control member.

15. The flow control system recited in claim 12 wherein said first and second seals are made of flexible materials.

16. The flow control system recited in claim 12 wherein said first seal is adhesively bonded within said first fluid flow channel.

17. The flow control system recited in claim 12 wherein said second seal is adhesively bonded within said second fluid flow channel.

18. The flow control system recited in claim 12 wherein an O-ring is supported on said first seal for sealing said first seal and valve member against leakage.

19. The flow control system recited in claim 12 wherein an opening is provided in said first fluid flow channel for retaining deformed portions of said spring when said spring has been engaged by said valve member.

20. The flow control system recited in claim 12 wherein said first system is positioned in a housing assemblage comprising first and second half portions, each having a plurality of opposed slots and snaps for interlocking said first half portion to said second half portion thereby forming interlocked half portions, said interlocked half portions defining a closed end portion and a partially opened end portion for receiving said first flow control member.

21. The flow control system recited in claim 20 wherein said first flow control member is trapped in said partially opened end portion.

22. A method for controlling fluid flow from a first system having a rust opening, to a second system having a second opening, said method comprising steps of:

providing a first flow control member positioned in said first opening of said first system, said first flow control member comprising a first body member, a first fluid flow channel through said first body member, a first seal having a first opening therethrough arranged in said first fluid flow channel, a fluid entrance port through said first body member in fluid communication with said first fluid flow channel, a spring retained in said first fluid flow channel, and a valve member normally biased by said spring against said first seal to close said first opening through said first seal;

providing a second flow control member positioned in said second opening of said second system, said second flow control member comprising a second body member, a second fluid flow channel through said second body member, a second seal having a second opening therethrough arranged in said second fluid flow channel, a shoulder in said second fluid flow channel, a stop member slidable in said second fluid flow channel, and a proboscis member extended from said stop member and slidable axially in said second opening of said second seal until, in one direction, said proboscis member comes to rest against said shoulder in said second body member and penetrates said first opening of said first seal, said proboscis member having an open end portion extended from one side of said second seal, at least one exit port within the second body member, and a through channel extending from said open end portion to said exit port;

urging said first opening of said first system toward said second opening of said second system so that said proboscis member at least partially penetrates said first opening of said first seal, and engages and displaces said valve member toward said spring thereby opening a first flow path extending between said entrance port, said open end portion of said proboscis member, and through said through channel;

urging said first opening of said first system into proximate contact with said second opening of said second system thereby opening a second fluid flow path extending from said entrance port, to said open end portion, through said through channel, through said exit port of said proboscis member and terminating in said second fluid flow channel of said second system; and urging said first opening of said first system away from said second opening of said second system, thereby closing said first fluid flow path and said se, cond fluid flow path.

* * * * *

UNITED STATES PATENT AND TRADEMARK OFFICE

CERTIFICATE OF CORRECTION

PATENT NO. : 5,560,405
DATED : October 1, 1996
INVENTOR(S) : Clark E. Harris et al.

It is certified that errors appear in the above-identified patent and that said Letters Patent is hereby corrected as shown below:

Col. 13, line 13, "rust" should read --first--

Col. 14, line 32, "se, cond" should read --second --

Signed and Sealed this

Eighteenth Day of November 1997

*Attest:*

Bruce Lehman

BRUCE LEHMAN

*Attesting Officer*

*Commissioner of Patents and Trademarks*